US008536106B2

(12) United States Patent
Miralles

(10) Patent No.: US 8,536,106 B2
(45) Date of Patent: Sep. 17, 2013

(54) FERRIC HYDROXYCARBOXYLATE AS A BUILDER

(75) Inventor: Altony Miralles, Woodbury, MN (US)

(73) Assignee: Ecolab USA Inc., Saint Paul, MN (US)

( * ) Notice: Subject to any disclaimer, the term of this patent is extended or adjusted under 35 U.S.C. 154(b) by 282 days.

(21) Appl. No.: 12/760,095

(22) Filed: Apr. 14, 2010

(65) Prior Publication Data

US 2011/0257071 A1 Oct. 20, 2011

(51) Int. Cl.
*C11D 1/00* (2006.01)
*C11D 3/02* (2006.01)
*C11D 3/16* (2006.01)

(52) U.S. Cl.
USPC ..... 510/191; 510/238; 510/245; 510/255; 510/272; 510/434; 510/477; 510/488; 510/505

(58) Field of Classification Search
USPC ..... 510/191, 238, 245, 255, 272, 434, 510/477, 488, 505
See application file for complete search history.

(56) References Cited

U.S. PATENT DOCUMENTS

| | | | |
|---|---|---|---|
| 1,846,880 | A | 2/1932 | Kussmaul |
| 3,166,474 | A | 1/1965 | Sieger et al. |
| 3,506,761 | A | 4/1970 | Rubino |
| 3,589,859 | A | 6/1971 | Foroulis |
| 3,655,883 | A | 4/1972 | Granatek et al. |
| 3,711,246 | A | 1/1973 | Foroulis |
| 3,712,948 | A | 1/1973 | Halpern et al. |
| 3,755,294 | A | 8/1973 | Walon |
| 4,108,790 | A | 8/1978 | Foroulis |
| 4,181,516 | A | 1/1980 | Gray |
| 4,191,551 | A | 3/1980 | Cupery |
| 4,279,768 | A | 7/1981 | Busch |
| 4,331,518 | A | 5/1982 | Wilson |
| 4,382,098 | A | 5/1983 | Bolin et al. |
| 4,455,250 | A | 6/1984 | Frazier |
| 4,474,626 | A | 10/1984 | Lumaret et al. |
| 4,476,626 | A | 10/1984 | Gumbert et al. |
| 4,495,186 | A | 1/1985 | Mora |
| 4,521,332 | A | 6/1985 | Milora |
| 4,539,122 | A | 9/1985 | Son et al. |
| 4,618,601 | A | 10/1986 | Chazot et al. |
| 4,788,281 | A | 11/1988 | Tosoni et al. |

(Continued)

FOREIGN PATENT DOCUMENTS

| | | |
|---|---|---|
| CN | 1128109 | 8/1996 |
| CN | 1209997 | 3/1999 |

(Continued)

OTHER PUBLICATIONS

Allain, P., et al., "Study on hypnotic activity potentiation of penotobarbital by different aluminum salts in mice", Journal de Pharmacologie (1980), 11(2), pp. 149-153.

(Continued)

*Primary Examiner* — Gregory Delcotto
(74) *Attorney, Agent, or Firm* — McKee, Voorhees & Sease, P.L.C.

(57) ABSTRACT

The use of ferric hydroxycarboxylate as a chelator and builder for cleaning compositions is disclosed. The cleaning composition may be formulated for warewashing, laundering, and for other means of removing soils and includes a ferric hydroxycarboxylate, an alkalinity source and a surfactant system. The cleaning composition has a pH of between about 9 and about 12.

10 Claims, 2 Drawing Sheets

(56) References Cited

U.S. PATENT DOCUMENTS

| | | | | |
|---|---|---|---|---|
| 4,828,743 | A * | 5/1989 | Rahfield et al. | 510/363 |
| 4,933,266 | A | 6/1990 | Stephen et al. | |
| 4,975,290 | A | 12/1990 | Artz et al. | |
| 5,094,845 | A | 3/1992 | Vlock | |
| 5,149,459 | A | 9/1992 | Olson et al. | |
| 5,149,460 | A | 9/1992 | Olson et al. | |
| 5,219,484 | A | 6/1993 | Krulik | |
| 5,376,544 | A | 12/1994 | Lazarus et al. | |
| 5,383,486 | A | 1/1995 | Warner et al. | |
| 5,417,287 | A | 5/1995 | Smith et al. | |
| 5,434,035 | A | 7/1995 | Craver et al. | |
| 5,508,150 | A | 4/1996 | Craver et al. | |
| 5,531,915 | A | 7/1996 | Perkins | |
| 5,534,181 | A | 7/1996 | Henkel et al. | |
| 5,614,010 | A | 3/1997 | Smith et al. | |
| 5,647,900 | A | 7/1997 | Smith et al. | |
| 5,753,304 | A | 5/1998 | Tung | |
| 5,759,977 | A | 6/1998 | van den Brom et al. | |
| 5,777,434 | A | 7/1998 | Dietrich et al. | |
| 5,800,830 | A | 9/1998 | Asano et al. | |
| 5,804,172 | A | 9/1998 | Ault | |
| 5,904,162 | A | 5/1999 | Ferguson et al. | |
| 5,961,663 | A | 10/1999 | Schramm, Jr. | |
| 5,997,937 | A | 12/1999 | Hembling et al. | |
| 6,006,767 | A | 12/1999 | Hecker et al. | |
| 6,083,894 | A | 7/2000 | Keyes et al. | |
| 6,103,686 | A | 8/2000 | Asakawa et al. | |
| 6,136,860 | A | 10/2000 | Rushton | |
| 6,274,179 | B1 | 8/2001 | Theuer | |
| 6,274,279 | B1 | 8/2001 | Hampp et al. | |
| 6,290,835 | B1 | 9/2001 | McKesson, Jr. et al. | |
| 6,358,544 | B1 | 3/2002 | Henry, Jr. et al. | |
| 6,448,210 | B1 | 9/2002 | Keyes et al. | |
| 6,454,820 | B2 * | 9/2002 | Hagihara et al. | 51/308 |
| 6,509,045 | B2 | 1/2003 | Henry et al. | |
| 6,525,010 | B2 | 2/2003 | Peterson et al. | |
| 6,635,631 | B2 | 10/2003 | Stockham et al. | |
| 6,664,219 | B1 | 12/2003 | Lentsch et al. | |
| 6,693,211 | B2 | 2/2004 | Kumari et al. | |
| 6,703,056 | B2 | 3/2004 | Mehansho et al. | |
| 6,710,028 | B2 | 3/2004 | Lehmann | |
| 6,746,611 | B2 | 6/2004 | Davidson | |
| 6,773,924 | B2 | 8/2004 | Beck et al. | |
| 6,908,893 | B2 | 6/2005 | Murphy | |
| 6,929,954 | B2 | 8/2005 | Beck et al. | |
| 7,005,531 | B2 | 2/2006 | Justus et al. | |
| 7,125,704 | B2 | 10/2006 | Miyake et al. | |
| 7,135,448 | B2 | 11/2006 | Lentsch et al. | |
| 7,138,151 | B2 | 11/2006 | Calapini et al. | |
| 7,179,939 | B2 | 2/2007 | Rangisetty et al. | |
| 7,186,544 | B2 | 3/2007 | Koyama et al. | |
| 7,196,044 | B2 | 3/2007 | Smith et al. | |
| 7,196,045 | B2 | 3/2007 | Lentsch et al. | |
| 7,241,391 | B1 | 7/2007 | Miksic et al. | |
| 7,452,853 | B2 | 11/2008 | Smith et al. | |
| 7,459,569 | B2 | 12/2008 | Stockham | |
| 2002/0076821 | A1 | 6/2002 | Beck et al. | |
| 2002/0114764 | A1 | 8/2002 | Berryman et al. | |
| 2002/0114767 | A1 | 8/2002 | Rolla | |
| 2003/0181345 | A1 * | 9/2003 | Bian | 510/175 |
| 2003/0190355 | A1 | 10/2003 | Hermelin et al. | |
| 2003/0216566 | A1 | 11/2003 | Kumari et al. | |
| 2004/0038930 | A1 | 2/2004 | Beck et al. | |
| 2004/0167037 | A1 | 8/2004 | Davidson | |
| 2004/0192995 | A1 | 9/2004 | Deshpande et al. | |
| 2004/0253345 | A1 | 12/2004 | Vorage et al. | |
| 2004/0259757 | A1 | 12/2004 | Gladfelter et al. | |
| 2005/0037996 | A1 | 2/2005 | Beck et al. | |
| 2005/0129825 | A1 | 6/2005 | Gray et al. | |
| 2005/0209322 | A1 | 9/2005 | Rangisetty et al. | |
| 2005/0281915 | A1 | 12/2005 | Metzger et al. | |
| 2006/0000150 | A1 * | 1/2006 | Kelley et al. | 51/298 |
| 2006/0000151 | A1 * | 1/2006 | Kelley et al. | 51/298 |
| 2006/0046964 | A1 | 3/2006 | Morneau | |
| 2006/0069276 | A1 | 3/2006 | Justus et al. | |
| 2006/0122093 | A1 | 6/2006 | Permejo | |
| 2006/0128795 | A1 | 6/2006 | Koyama et al. | |
| 2006/0134227 | A1 | 6/2006 | Bortz et al. | |
| 2006/0217291 | A1 | 9/2006 | Hirotsu et al. | |
| 2006/0286207 | A1 | 12/2006 | Gray | |
| 2007/0034236 | A1 | 2/2007 | Reichold | |
| 2007/0149431 | A1 | 6/2007 | Lentsch et al. | |
| 2007/0161528 | A1 * | 7/2007 | Wu et al. | 510/175 |
| 2007/0287654 | A1 | 12/2007 | Hsu et al. | |
| 2008/0011321 | A1 * | 1/2008 | Ikemoto et al. | 134/1.3 |
| 2008/0020960 | A1 | 1/2008 | Smith et al. | |
| 2008/0128004 | A1 | 6/2008 | Doherty et al. | |
| 2008/0194452 | A1 * | 8/2008 | Tsai et al. | 510/433 |
| 2008/0274930 | A1 | 11/2008 | Smith et al. | |
| 2008/0274936 | A1 | 11/2008 | Adamy et al. | |
| 2008/0287334 | A1 | 11/2008 | Smith et al. | |
| 2009/0035385 | A1 | 2/2009 | Bortz | |
| 2009/0038649 | A1 | 2/2009 | Smith et al. | |

FOREIGN PATENT DOCUMENTS

| | | | |
|---|---|---|---|
| CN | 1433974 | | 8/2003 |
| CN | 1491655 | | 4/2004 |
| CN | 1557957 | | 12/2004 |
| CN | 1817247 | | 8/2006 |
| DE | 0042640 | | 8/1930 |
| DE | 2005527 | | 8/1971 |
| DE | 2518584 | | 11/1976 |
| DE | 19734293 | A1 | 2/1999 |
| EP | 0999254 | A1 | 5/2000 |
| EP | 1876187 | A1 | 9/2008 |
| GB | 1467931 | | 3/1977 |
| JP | 60260401 | | 12/1985 |
| JP | 1988250664 | | 10/1988 |
| JP | 07018484 | | 1/1995 |
| JP | 10204662 | | 8/1998 |
| JP | 2000051336 | | 2/2000 |
| JP | 2000286158 | | 10/2000 |
| WO | 9310821 | | 6/1993 |
| WO | 9528937 | | 11/1995 |
| WO | 9907401 | | 2/1999 |
| WO | 9908650 | | 2/1999 |
| WO | 0115796 | A1 | 8/2001 |
| WO | 2004019057 | | 12/2004 |
| WO | 2005000210 | A2 | 1/2005 |
| WO | 2006111802 | A1 | 10/2006 |
| WO | 2007145147 | A1 | 12/2007 |

OTHER PUBLICATIONS

Amjad, Zahid, et al., "Inhibition of Calcium Phosphate Precipitation by Polymers in the Presence of Iron (III). The Influence of Chelating Agents", Advances in Crystal Growth Inhibition Technologies, Plenum Publishers, New York, 2000.

Bates, George, et al., "Complex Formation, Polymerization, and Autoreduction in the Ferrie Fructose System", Bioinorganic Chemistry 2, (1973), pp. 311-327.

Bechtold, Thomas, et al., "Ca2+-Fe3+-D-gluconate-complexes in alkaline solution. Complex stabilities and electrochemical properties", The Royal Society of Chemistry, J. Chem. Soc., Dalton Trans., 2002, pp. 2683-2688.

Coyne, Daniel W., et al., "Ferric Gluconate is Highly Efficacious in Anemic Hemodialysis Patients with High Serum Ferritin and Low Transferrin Saturation: Results of the Dialysis Patients' Response to IV Iron with Elevated Ferritin (DRIVE) Study", Am. Soc. Nephrol 18, 2007, pp. 975-984.

Crichion, Robert R., et al., "Molecular and Cellular mechanisms of iron homeostatis and toxicity in mammallian cells", Journal of Inorganic Biochemistry, Elsevier Science, Inc., 2002.

Ferrari, E., et al., "Iron (III) complexing ability of carbohydrate derivatives", Journal of Inorganic Biochemistry, Elsevier Science, Inc., 2004.

Gonzalez-Velasco, J., Electromigration behavior of complexes between iron(III) and copper(II) ions and gluconic acid, Anales de Quimica (1968-1979) (1980), 76(1), pp. 17-21.

Gonzalez-Velasco, J., et al., "Estudio Potenciometrico De La Estequiometria Y Constantes De Estabilidad De Algunos Complejos Del Acido D(+)Sacarico Con Iones Metalicos De Transicon", Anales De Quimica, Jul. 19, 1975.

Gonzalez-Velasco, J., et al., "On the Composition and Stability of Some D(+) Saccharic Acid Complexes", J. Inorg. Nucl. Chem., 1976, vol. 38, pp. 889-895.
Gonzalez-Velasco, J., et al., "Spectrophotometric Study of the Composition and Stability of Some D(+) Saccharic Acid Complexes", Anales De Quimica, Oct. 31, 1974.
Gotloib, Lazaro, et al., "Iron deficiency is a common cause of anemia in chronic kidney disease and can often be corrected with intravenous iron", J. Nephrol 2006: 19: pp. 161-167.
Gyurcsik, Bela, et al., "Carbohydrates as ligands: coordination equilibria and structure of the metal complexes", Elsevier—Coordination Chemistry Reviews, 203 (2000) pp. 81-149.
Kapoian, Toros, et al., "Ferric Gluconate Reduces Epoetin Requirements in Hemodialysis Patients with Elevated Ferritin", J. Am. Soc. Nephrol 19: (2008) pp. 372-379.
Kudasheva, Dina S., et al., "Structure of carbohydrate-bound polynuclear iron oxyhydroxide nanoparticles in parenteral formulations", Elsevier, Journal of Inorganic Biochemistry 98 (2004), pp. 1757-1769.
Lakatos, Andrea, et al, "Complexes of A1(III) with D-gluconic acid", Elsevier, Polyhedron 27 (2008), pp. 118-124.
Lalle, M., et al, "Epoetin Alfa 40000 U Once Weekly and Intravenous Iron Supply in Solid Tumor Patients: Early Increase of Hemoglobin Level during Chemotherapy", J. Exp. Clin., Cancer Res. 24, 2, 2005.
Lehmann, H., "Iron preparations for new pharmacopeia", Schweizerische Apotheker-Zeitung (1957), 95, pp. 883-885.
Luo, Ying, et al., "Study on relationship between Cu-Zn SOD activity and aluminum induced neurodegeneration in mice brain", Gongye Weisheng Yu Zhiyebing (2007), 33(6), pp. 349-353.
McShan, W.H., et al., "Effectiveness of heme in the augmentation of gonadotropic extracts from different sources", Endocrinology (1941), 28, pp. 694-700.
Mehltretter, C.L., "Sequestration by Sugar Acids", Industrial and Engineering Chemistry, vol. 45, No. 12, (2000).
Miu, Andrei C., et al., "A behavioral and ultrastructural dissection of the interference of aluminum with aging", Journal of Alzheimer's Disease 6 (2004) pp. 315-328.
Nakata, Yozo, et al., "D-Amino acids oxidase and homogentisate oxygenase activities in tumor-bearing rats", Journal of Biochemistry (Tokyo, Japan), (1963), 53(6), pp. 505-507.
Neiger, Richard, et al., "The photochemical reactions of the iron gluconates", Z. physik. Chem. (1936), A177, pp. 355-364.
Kosmider, Stanislaw, "Versenate in iron-deficiency anemia", Polskie Archiwum Medycyny Wewnetrznej (1970), 44(2), pp. 121.126.
Okuhata, Yoshitaka, et al., "An experimental study on MR lymphography with various iron colloid agents", Nippon Igaku Hoshasen Gakkai Zasshi (1992), 52(8), pp. 1148-1160.
Oshika, Eitatsu, "Iron metabolism in infancy and childhood. WIII. Intravenous iron tolerance tests in experimental anemia", Sapporo Igaku Zasshi (1958), 13, pp. 133-140.
Panda, C., et al, "Gluconate Complexes of A1 (III) and Fe (III)", J. Inst. Chemists (India), vol. XLIX, Nov. 1977.
Pecsok, Robert L., et al., "The Gluconate Complexes. II. The Ferric-Gluconate System", The Ferric-Gluconate System, Mar. 20, 1955, p. 1489.
Saladini, Monica, Sugar complexes with metal2 + ions: thermodynamic parameters of associates of Ca2+, mg2+ and Zn2+ with galactaric acid, Elsevier, Carbohydrate Research 336 (2001), pp. 55-61.
Samochowiec, Leonidas, "Intestinal absorption of sodium ferric gluconate", Clinica Terapeutica (Rome) (1971), 56(4), pp. 341-345.
Struys-Ponsar, C., et al., "Effects of Aluminum Exposure on Glutamate Metabolism: A Possible Explanation for its Toxicity", Experimental Neurology 163 (2001), pp. 157-164.
Struys-Ponsar, C., et al., "Effects of Aluminum Exposure on Behavioral Parameters in the Rat", Pharmacology Biochemistry and Behavior, vol. 56, No. 4, pp. 643-648, 1997.
Struys-Ponsar, Cecile, et al., "Effects of Aluminum on Glutamate Metabolism—A Possible Explanation for Its Toxicity in the Aged Rats and in an Experimental Model of Aluminum Overload", Trace Elements in Man and Animals 10, Kluwer Academic/Plenum Publishers, New York, 2000.
Tanabe, Hideo, "Iron complexes. II. Preparation and properties of sodium ferric gluconate complex", Takeda Kenkyusho Nenpo (1962), 21, pp. 1-10.
Tanabe, Hideo, et al., "Iron complexes. III. Iron complex ions by paper electrophoresis", Takeda Kenkyusho Nempo (1962), 21, pp. 11-19.
Tanabe, Hideo, "Iron complexes. IV. Polarography of sodium ferric gluconate complex", Takeda Kenkyusho Nempo (1962), 21, pp. 20-25.
Tessitore, Nicola, "The role of iron status markers in predicting response to intravenous iron in haemodialysis patents on maintenance erythropoietin", Nephro Dial. Transplant. (2001) 16: pp. 1416-1423.
Traube, Wilhelm, "Ferric complex salts of aliphatic polyhydroxy compounds", Berichte der Deutschen Chemischen Gesellschaft (1933), 66B, pp. 1545-1556.
Van Den Brink, P.J., et al., "Use of chelating agents for the preparation of iron oxide catalysts for the selective oxidation of hydrogen sulfide", Studies in Surface Science and Catalysis (1991), 63(Prep. Catal. 5), pp. 527-536.
Van Wyck, David, et al., "Labile iron in parenteral iron formulations: a quantitative and comparative study", Nephrol. Dial. Transplant. (2004), 19: pp. 561-565.
Ward, Roberta J., et al., "Aluminum toxicity and iron homeostasis", Elsevier, Journal of Inorganic Biochemistry 87 (2001), pp. 9-14.

* cited by examiner

FERRIC HYDROXYCARBOXYLATE AS A BUILDER

TECHNICAL FIELD

The present invention is related to the field of cleaning compositions/detergents. In particular, the present invention is related to a cleaning composition including a ferric hydroxycarboxylate as a builder.

BACKGROUND OF THE INVENTION

Conventional cleaning compositions/detergents used in the vehicle care, warewashing and laundry industries include alkaline detergents. Alkaline detergents, particularly those intended for institutional and commercial use, generally contain phosphates, nitrilotriacetic acid (NTA) and ethylenediaminetetraacetic acid (EDTA). Phosphates, NTA and EDTA are components commonly used in detergents to remove soils and to sequester metal ions such as calcium, magnesium and iron.

In particular, NTA, EDTA or polyphosphates such as sodium tripolyphosphate and their salts are used in detergents because of their ability to solubilize preexisting inorganic salts and/or soils. When calcium, magnesium salts precipitate, the crystals may attach to the surface being cleaned and cause undesirable effects. For example, calcium carbonate precipitation on the surface of ware can negatively impact the aesthetic appearance of the ware, giving an unclean look. In the laundering area, if calcium carbonate precipitates and attaches onto the surface of fabric, the crystals may leave the fabric feeling hard and rough to the touch. The ability of NTA, EDTA and polyphosphates to remove metal ions facilitates the detergency of the solution by preventing hardness precipitation, assisting in soil removal and/or preventing soil redeposition into the wash solution or wash water.

While effective, phosphates and NTA are subject to government regulations due to environmental and health concerns. Although EDTA is not currently regulated, it is believed that government regulations may be implemented due to environmental persistence. There is therefore a need in the art for an alternative, and preferably environment friendly, cleaning composition that can replace the properties of phosphorous-containing compounds such as phosphates, phosphonates, phosphites, and acrylic phosphinate polymers, as well as non-biodegradable aminocarboxylates such as NTA and EDTA.

SUMMARY OF THE INVENTION

The present invention includes a cleaning composition for removing soils. The cleaning composition includes a ferric hydroxycarboxylate, an alkalinity source and a surfactant system. The cleaning composition has a pH of between about 9 and about 12.

In one embodiment, the detergent composition includes between about 1% and about 60% ferric hydroxycarboxylate, between about 5% and about 80% alkalinity source, and between about 0.01% and about 50% surfactant system. The ferric hydroxycarboxylate has a molar ratio of between about 0.5:1.5 and about 1.5:0.5 alkali metal salt of a hydroxycarboxylate or free hydroxycarboxylic acid to ferric salt.

In yet another embodiment, the ferric hydroxycarboxylate is used in a method to remove soils. An alkali metal salt of a hydroxycarboxylate or free hydroxycarboxylic acid is mixed with a ferric salt at a molar ratio of between about 0.5:1.5 and about 1.5:0.5 to form a ferric hydroxycarboxylate. The ferric hydroxycarboxylate is then mixed with an alkalinity source and a surfactant system to form a cleaning composition. The cleaning composition is then diluted at a dilution ratio of between about 1:10 and about 1:10,000 to form a use solution. The use solution is then contacted with a substrate to be cleaned.

While multiple embodiments are disclosed, still other embodiments of the present invention will become apparent to those skilled in the art from the following detailed description, which shows and describes illustrative embodiments of the invention.

BRIEF DESCRIPTION OF THE FIGURES

FIG. 3 shows the percent tea soil removal of modified Solid Power detergent where GL-38 was replaced with ferric gluconate on a 1.8:1 active weight basis plus 10% free sodium gluconate. As can be seen, the soil removal for both systems is very similar.

DETAILED DESCRIPTION OF THE INVENTION

Definitions

Figure 1:
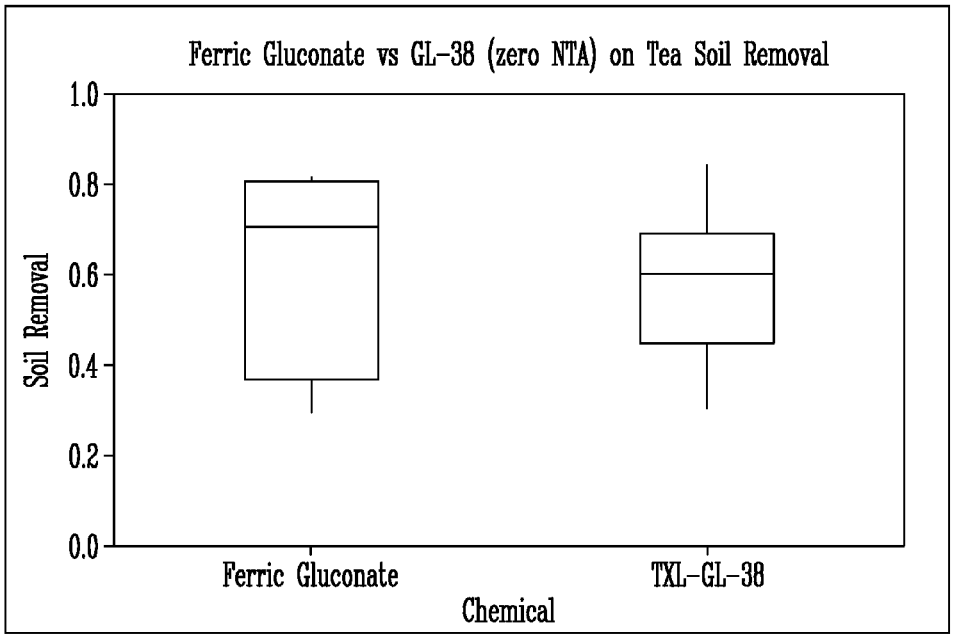
FIG. 1 is a graph of the percent tea soil removal of modified Solid Power detergent where NTA was replaced with ferric gluconate on a 1:1 active weight basis. As can be seen, ferric gluconate works as well as GL-38 (Glutamic Acid, N,N-Diacetic Acid, Tetrasodium Salt) on removing tea soil.

The following detailed description describes certain illustrative embodiments and is not to be taken in a limiting sense. All weights, amounts and ratios are by weight, unless otherwise specifically noted. Unless the context indicates otherwise the following terms shall have the following meaning and shall be applicable to the singular and plural:

The terms "a," "an," "the," "at least one," and "one or more" are used interchangeably. Thus a cleaning product that contains "a" magnesium compound may include "one or more" magnesium compounds.

The term "about" modifying the quantity of an ingredient in a composition or mixture or employed in the disclosed methods refers to variations such as may occur, for example, through typical measuring and liquid handling procedures used for making concentrates or use solutions in the real world; through inadvertent error in these procedures; through differences in the manufacture, source, or purity of the ingredients employed to make the compositions or carry out the methods; and the like. The term about also encompasses amounts that differ due to different equilibrium conditions for a composition made from a particular initial mixture. Whether or not modified by the term "about", the claims include equivalents to the recited quantities.

The term "antiredeposition agent" refers to a compound that helps keep the soil suspended in water instead of depositing or redepositing onto an object being cleaned.

The term "brand" refers to a name, symbol, logo, slogan, design or other indicia, including trademarks, service marks and portions thereof, whether or not registered, that a potential purchaser or user of a product or service perceives as representing an expected level of quality or performance for products or services manufactured or sold in association with the brand.

The terms "chelating agent" and "sequestrant" refer to a compound that forms a complex (soluble or not) with water hardness ions (e.g., from water already present in a cleaning composition, water added to a cleaning composition, wash water, rinse water, soil or a substrate being cleaned), or other metal ions present in the solution, in a specific molar ratio. The terms "chelating agent" and "sequestrant" normally are synonyms, and the term chelating agent will be used to refer to both chelating agents and sequestrants in the remainder of this application. Chelating agents that can form a water soluble complex include acids (or more commonly salts thereof, including sodium or potassium salts) such as sodium tripolyphosphate, EDTA, DTPA, NTA, citric acid, and the like.

The term "cleaning" refers to performing or aiding in soil removal, bleaching, microbial population reduction, rinsing, or combination thereof.

The term "cleaning composition" refers to a composition for cleaning hard or soft surfaces, including ware washing compositions, laundry detergents, hard surface cleaners and rinse aids.

The term "cleaning system" refers to a cleaning product and a water treatment product used together to clean hard or soft surfaces. The cleaning system components may be used contemporaneously, consecutively or combinations thereof. For example, a water treatment product may be used to treat water (e.g., in a water inlet line) which is then combined with the cleaning product and used to clean a hard or soft surface; by employing both the cleaning product and water treatment product at the same time (e.g., by adding both a cleaning product and a water treatment product to a ware wash or laundry cycle, or by applying both to a hard surface); or by using the cleaning product followed by rinsing, before the cleaned surface has had a chance to dry, using water treated with the water treatment product.

The term "commercially acceptable cleaning performance" refers generally to the degree of cleanliness, extent of effort, or both that a typical consumer would expect to achieve or expend when using a cleaning product or cleaning system to address a typical soiling condition on a typical substrate. This degree of cleanliness may, depending on the particular cleaning product and particular substrate, correspond to a general absence of visible soils, or to some lesser degree of cleanliness. For example, a shower cleaner or toilet bowl cleaner would be expected by a typical consumer to achieve an absence of visible soils when used on a moderately soiled but relatively new hard surface, but would not be expected to achieve an absence of visible soils when used on an old hard surface which already bears permanent stains such as heavy calcite deposits or iron discoloration. Cleanliness may be evaluated in a variety of ways depending on the particular cleaning product being used (e.g., ware or laundry detergent, rinse aid, hard surface cleaner, vehicular wash or rinse agent, or the like) and the particular hard or soft surface being cleaned (e.g., ware, laundry, fabrics, vehicles, and the like), and normally may be determined using generally agreed industry standard tests or localized variations of such tests. In the absence of such agreed industry standard tests, cleanliness may be evaluated using the test or tests already employed by a manufacturer or seller to evaluate the cleaning performance of other commercial cleaning products.

The term "similar cleaning performance" refers generally to achievement by a substitute cleaning product or substitute cleaning system of generally the same degree (or at least not a significantly lesser degree) of cleanliness or with generally the same expenditure (or at least not a significantly lesser expenditure) of effort, or both, when using the substitute cleaning product or substitute cleaning system rather than a branded phosphorus-containing cleaning to address a typical soiling condition on a typical substrate. This degree of cleanliness may, depending on the particular cleaning product and particular substrate, correspond to a general absence of visible soils, or to some lesser degree of cleanliness, as explained in the prior paragraph.

The term "hard surface" refers to an impervious cleanable substrate, for example materials made from ceramic, stone, glass or hard plastics including showers, sinks, toilets, bathtubs, countertops, windows, minors, transportation vehicles, walls, wooden or tile floors, patient-care equipment (for example diagnostic equipment, shunts, body scopes, bed frames, etc.), surgical equipment and the like.

The term "improved cleaning performance" refers generally to achievement by a substitute cleaning product or substitute cleaning system of a generally greater degree of cleanliness or with generally a reduced expenditure of effort, or both, when using the substitute cleaning product or substitute cleaning system rather than a branded phosphorus-containing cleaning product to address a typical soiling condition on a typical substrate. This degree of cleanliness may, depending on the particular cleaning product and particular substrate, correspond to a general absence of visible soils.

The terms "include" and "including" when used in reference to a list of materials refer to but are not limited to the materials so listed.

The term "phosphorus-free" refers to a composition, mixture, or ingredients that do not contain phosphorus-containing compounds or to which phosphorus or phosphorus-containing compounds have not deliberately been added. This term encompasses however the presence of phosphorus-containing compounds as unintended or unavoidable impurities, e.g., through the formulation by a manufacturer or dilution by an end user of a cleaning composition using water containing trace amounts of phosphorus-containing compounds. The term "substantially free of phosphorus" refers to a composition, mixture, or ingredients containing less than 0.2 wt. % phosphorus-containing compounds. The term "lacking an effective amount of phosphorus" refers to a composition, mixture, or ingredients containing too little phosphorus-containing compounds to affect measurably the hardness of water present in or employed with such composition, mixture or ingredient. The terms "phosphate-free" and "substantially free of phosphate" are defined similarly, with "phosphate" being substituted for "phosphorus" in the above definitions.

The term "soft surface" refers to a pervious cleanable substrate, for example materials made from woven, nonwoven or knit textiles, leather, including fabrics (for example surgical garments, draperies, bed linens, bandages, etc.), carpet, transportation vehicle seating and interior components and the like.

The term "solid" refers to a composition in a generally shape-stable form under expected storage conditions, for example a powder, particle, agglomerate, flake, granule, pellet, tablet, lozenge, puck, briquette, brick or block, and whether in a unit dose or a portion from which measured unit doses may be withdrawn. A solid may have varying degrees of shape stability, but typically will not flow perceptibly and will substantially retain its shape under moderate stress, pressure or mere gravity, as for example, when a molded solid is removed from a mold, when an extruded solid exits an extruder, and the like. A solid may have varying degrees of surface hardness, and for example may range from that of a fused solid block whose surface is relatively dense and hard, resembling concrete, to a consistency characterized as being malleable and sponge-like, resembling a cured caulking material.

The term "substitute cleaning product" refers to a product that is intended to be or may be used in place of a cleaning product containing a phosphorus-containing compound.

The term "threshold agent" refers to a compound that inhibits or alters crystallization of water hardness ions from solution, at less than stoichiometric concentration, but that need not form a specific complex with the water hardness ion and thereby may be distinguished from a chelating agent. Threshold agents include polycarboxylates, for example polymers and copolymers of acrylic acid, methacrylic acid, maleic acid and olefins. The term "free of threshold agent" refers to a composition, mixture, or ingredient that does not contain a threshold agent or to which a threshold agent has not deliberately been added. This term encompasses however the presence of threshold agents as unintended or unavoidable impurities, e.g., through the formulation by a manufacturer or dilution by an end user of a cleaning composition using water containing one or more threshold agents in trace amount, and the use of such water to manufacture or dilute a composition, mixture, or ingredient to which no other threshold agent had been added would still represent a composition, mixture or ingredient free of threshold agent.

The term "ware" refers to items used for cooking or eating, for example pots, pans, cooking utensils, plates, cups, glasses and eating utensils. The term "warewashing" refers to washing, rinsing or otherwise cleaning ware.

The term "water soluble" refers to a compound that can be dissolved in water at a concentration of more than 1 wt. %. The terms "sparingly soluble" or "sparingly water soluble" refer to a compound that can be dissolved in water only to a concentration of 0.1 to 1.0 wt. %. The term "water insoluble" refers to a compound that can be dissolved in water only to a concentration of less than 0.1 wt. %. The term "water treatment product" refers to a product that reduces solubilized water hardness ions (e.g., $Ca^{++}$ and $Mg^{++}$ ions).

Cleaning Composition

The present invention relates to cleaning compositions which include a ferric hydroxycarboxylate as a builder. Such ferric hydroxycarboxylate compositions of the invention exhibit detergency, soil suspension and anti-redeposition properties. The cleaning compositions can be applied in any environment where it is desirable to remove soils and to prevent the precipitation of magnesium and calcium. For example, the cleaning composition can be used in vehicle care applications, warewashing applications, laundering applications and food and beverage applications. Such applications include, but are not limited to: machine and manual warewashing, presoaks, laundry and textile cleaning and destaining, carpet cleaning and destaining, vehicle cleaning and care applications, surface cleaning and destaining, kitchen and bath cleaning and destaining, floor cleaning and destaining, cleaning in place operations, general purpose cleaning and destaining, and industrial or household cleaners. Methods of using the cleaning composition are also provided.

Unlike most cleaning compositions currently known in the art, the cleaning compositions of the present invention does not require that phosphorous, NTA or EDTA be present in order to be effective. Thus, the cleaning compositions may be biodegradable and substantially free of phosphorous and aminocarboxylates such as NTA and EDTA, making the cleaning compositions particularly useful in cleaning applications where it is desired to use an environmentally friendly cleaning composition.

The cleaning compositions generally include a ferric hydroxycarboxylate, an alkalinity source, and a surfactant or surfactant system. A suitable concentration range of the components in the cleaning composition includes between approximately 1% and approximately 60% by weight ferric hydroxycarboxylate, between approximately 5% and approximately 80% by weight alkalinity source and between approximately 0.01% and approximately 50% by weight surfactant or surfactant system. A particularly suitable concentration range of the components in the cleaning composition includes between approximately 1% and approximately 45% by weight ferric hydroxycarboxylate, between approximately 20% and approximately 75% by weight alkalinity source and between approximately 0.5% and approximately 40% by weight surfactant or surfactant system.

Examples of suitable ferric hydroxycarboxylates include, but are not limited to: ferric gluconate, ferric glucoheptonate, ferric mucate, ferric tartrate, ferric glucarate, ferric saccharate and ferric malate. A particularly suitable ferric hydroxycarboxylate is ferric gluconate.

The ferric hydroxycarboxylate is made by reacting the appropriate alkali metal salt (Li, Na, K, Rb, Cs) of the hydroxycarboxylate or the free hydroxycarboxylic acid with any water soluble ferric salt. Examples of suitable ferric salts dissolved with an alkali metal hydroxide include, but are not limited to, ferric sulfate and ferric chloride. The mole ratio of the alkali metal salt of the hydroxycarboxylate or the free hydroxycarboxylic acid to ferric salt is at least about 1:1 and particularly about 1:1. The weight ratio of the alkali metal salt of the hydroxycarboxylate or the free hydroxycarboxylic acid to ferric salt is between about 40:60 and about 75:25. Other polar solvents where the ferric salt and the hydroxycarboxylic acid and/or a hydroxycarboxylate salt are soluble will also yield the formation of ferric hydroxycarboxylate.

The cleaning composition also includes an alkalinity source, such as an alkali metal hydroxide, alkali metal carbonate, or alkali metal silicate. Examples of suitable alkalinity sources include, but are not limited to: sodium hydroxide, potassium hydroxide, sodium carbonate, potassium carbonate or a mixture of alkali metal hydroxide and alkali metal carbonate. The alkalinity source controls the pH of the resulting solution when water is added to the cleaning composition to form a use solution. The pH of the use solution must be maintained in the alkaline range in order to provide sufficient detergency properties. In an embodiment, the pH of the solution is between approximately 9 and approximately 14.

Particularly, the pH of the use solution is between about 10 and about 12. More particularly, the pH of the use solution is between about 11 and about 12. If the pH of the use solution is too low, for example, below approximately 9, the use solution may not provide adequate detergency properties. If the pH of the use solution is too high, for example, above approximately 12, the use solution may be too alkaline and attack or damage the surface to be cleaned.

The cleaning composition also includes a surfactant or surfactant system. A variety of surfactants may be used, including anionic, nonionic, cationic, and zwitterionic surfactants. For a discussion of surfactants, see Kirk-Othmer, Encyclopedia of Chemical Technology, Third Edition, volume 8, pages 900-912, which is incorporated herein by reference.

Examples of suitable anionic surfactants useful in the cleaning compositions of the invention include, but are not limited to: carboxylates such as alkylcarboxylates (carboxylic acid salts) and polyalkoxycarboxylates, alcohol ethoxylate carboxylates, nonylphenol ethoxylate carboxylates and the like; sulfonates such as alkylsulfonates, alkylbenzenesulfonates, alkylarylsulfonates, sulfonated fatty acid esters and the like; sulfates such as sulfated alcohols, sulfated alcohol ethoxylates, sulfated alkylphenols, alkylsulfates, sulfosuccinates, alkylether sulfates and the like. Some particularly suitable anionic surfactants include, but are not limited to: sodium alkylarylsulfonate, alpha-olefinsulfonate and fatty alcohol sulfates.

Nonionic surfactants useful in the cleaning composition include those having a polyalkylene oxide polymer as a portion of the surfactant molecule. Examples of suitable nonionic surfactants include, but are not limited to: chlorine-, benzyl-, methyl-, ethyl-, propyl, butyl- and alkyl polyethylene glycol ethers of fatty alcohols; polyalkylene oxide free nonionics such as alkyl polyglucosides; sorbitan and sucrose esters and their ethoxylates; alkoxylated ethylene diamine; alcohol alkoxylates such as alcohol ethoxylate propoxylates, alcohol propoxylates, alcohol propoxylate ethoxylate propoxylates, alcohol ethoxylate butoxylates and the like; nonylphenol ethoxylate, polyoxyethylene glycol ethers and the like; carboxylic acid esters such as glycerol esters, polyoxyethylene esters, ethoxylated and glycol esters of fatty acids and the like; carboxylic amides such as diethanolamine condensates, monoalkanolamine condensates, polyoxyethylene fatty acid amides and the like; and polyalkylene oxide block copolymers including an ethylene oxide/propylene oxide block copolymer. Examples of suitable commercially available nonionic surfactants include, but are not limited to: PLURONIC, available from BASF Corporation, Florham Park, N.J. and ABIL B8852, available from Goldschmidt Chemical Corporation, Hopewell, Va.

Cationic surfactants useful for inclusion in the cleaning composition include, but are not limited to: quaternary ammonium salts, as for example, alkylquaternary ammonium chloride surfactants such as n-alkyl(C12-C18)dimethylbenzyl ammonium chloride, n-tetradecyldimethylbenzylammonium chloride monohydrate, and naphthalene-substituted quaternary ammonium chlorides such as dimethyl-1-naphthylmethylammonium chloride. For a more extensive list of surfactants, see McCutcheon's Emulsifiers and Detergents, which is incorporated herein by reference.

Additional Functional Materials

The cleaning composition may contain other functional materials that provide desired properties and functionalities to the cleaning composition. For the purpose of this application, the term "functional materials" includes a material that when dispersed or dissolved in a use and/or concentrate solution, such as an aqueous solution, provides a beneficial property in a particular use. Examples of such functional materials include, but are not limited to: cleaning agents; rinse aids; bleaching agents; sanitizers/anti-microbial agents; activators; detergent builders or fillers; defoaming agents, anti-redeposition agents; optical brighteners; dyes/odorants; secondary hardening agents/solubility modifiers; pesticides for pest control applications; or the like, or a broad variety of other functional materials, depending upon the desired characteristics and/or functionality of the cleaning composition.

In particular, the cleaning composition may include a threshold system as disclosed in co-pending application titled "High Alkaline Detergent Composition With Enhanced Scale Control" which is incorporated herein by reference. Some more particular examples of functional materials are discussed in more detail below, but it should be understood by those of skill in the art and others that the particular materials discussed are given by way of example only, and that a broad variety of other functional materials may be used. For example, many of the functional materials discussed below relate to materials used in cleaning and/or destaining applications, but it should be understood that other embodiments may include functional materials for use in other applications.

Rinse Aids

The cleaning composition can optionally include a rinse aid composition, for example a rinse aid formulation containing a wetting or sheeting agent combined with other optional ingredients in a solid composition made using the binding agent. The rinse aid components are capable of reducing the surface tension of the rinse water to promote sheeting action and/or to prevent spotting or streaking caused by beaded water after rinsing is complete, for example in warewashing processes. Examples of sheeting agents include, but are not limited to: polyether compounds prepared from ethylene oxide, propylene oxide, or a mixture in a homopolymer or block copolymer structure. Such polyether compounds are known as polyalkylene oxide polymers, polyoxyalkylene polymers or polyalkylene glycol polymers. Such sheeting agents require a region of relative hydrophobicity and a region of relative hydrophilicity to provide surfactant properties to the molecule.

Bleaching Agents

The cleaning composition can optionally include a bleaching agent for lightening or whitening a substrate, and can include bleaching compounds capable of liberating an active halogen species, such as $Cl_2$, $Br_2$, —OCl— and/or —OBr—, or the like, under conditions typically encountered during the cleansing process. Examples of suitable bleaching agents include, but are not limited to: chlorine-containing compounds such as chlorine, a hypochlorite or chloramines. Examples of suitable halogen-releasing compounds include, but are not limited to: alkali metal dichloroisocyanurates, alkali metal hypochlorites. Encapsulated chlorine sources may also be used to enhance the stability of the chlorine source in the composition (see, for example, U.S. Pat. Nos. 4,618,914 and 4,830,773, the disclosures of which are incorporated by reference herein). The bleaching agent may also include an agent containing or acting as a source of active oxygen. The active oxygen compound acts to provide a source of active oxygen and may release active oxygen in aqueous solutions. An active oxygen compound can be inorganic, organic or a mixture thereof. Examples of suitable active oxygen compounds include, but are not limited to: peroxygen compounds, peroxygen compound adducts, hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine.

Sanitizers/Anti-Microbial Agents

The cleaning composition can optionally include a sanitizing agent (or antimicrobial agent). Sanitizing agents, also known as antimicrobial agents, are chemical compositions that can be used to prevent microbial contamination and deterioration of material systems, surfaces, etc. Generally, these materials fall in specific classes including phenolics, halogen compounds, quaternary ammonium compounds, metal derivatives, amines, alkanol amines, nitro derivatives, anilides, organosulfur and sulfur-nitrogen compounds and miscellaneous compounds.

The given antimicrobial agent, depending on chemical composition and concentration, may simply limit further proliferation of numbers of the microbe or may destroy all or a portion of the microbial population. The terms "microbes" and "microorganisms" typically refer primarily to bacteria, virus, yeast, spores, and fungus microorganisms. In use, the antimicrobial agents are typically formed into a solid functional material that when diluted and dispensed, optionally, for example, using an aqueous stream forms an aqueous disinfectant or sanitizer composition that can be contacted with a variety of surfaces resulting in prevention of growth or the killing of a portion of the microbial population. A three log reduction of the microbial population results in a sanitizer composition. The antimicrobial agent can be encapsulated, for example, to improve its stability.

Examples of suitable antimicrobial agents include, but are not limited to, phenolic antimicrobials such as pentachlorophenol; orthophenylphenol; chloro-p-benzylphenols; p-chloro-m-xylenol; quaternary ammonium compounds such as alkyl dimethylbenzyl ammonium chloride; alkyl dimethylethylbenzyl ammonium chloride; octyl decyldimethyl ammonium chloride; dioctyl dimethyl ammonium chloride; and didecyl dimethyl ammonium chloride. Examples of suitable halogen containing antibacterial agents include, but are not limited to: sodium trichloroisocyanurate, sodium dichloro isocyanate (anhydrous or dihydrate), iodine-poly (vinylpyrrolidinone) complexes, bromine compounds such as 2-bromo-2-nitropropane-1,3-diol, and quaternary antimicrobial agents such as benzalkonium chloride, didecyldimethyl ammonium chloride, choline diiodochloride, and tetramethyl phosphonium tribromide. Other antimicrobial compositions such as hexahydro-1,3,5-tris(2-hydroxyethyl)-s-triazine, dithiocarbamates such as sodium dimethyldithiocarbamate, and a variety of other materials are known in the art for their antimicrobial properties.

It should also be understood that active oxygen compounds, such as those discussed above in the bleaching agents section, may also act as antimicrobial agents, and can even provide sanitizing activity. In fact, in some embodiments, the ability of the active oxygen compound to act as an antimicrobial agent reduces the need for additional antimicrobial agents within the composition. For example, percarbonate compositions have been demonstrated to provide excellent antimicrobial action.

Activators

In some embodiments, the antimicrobial activity or bleaching activity of the cleaning composition can be enhanced by the addition of a material which, when the cleaning composition is placed in use, reacts with the active oxygen to form an activated component. For example, in some embodiments, a peracid or a peracid salt is formed. For example, in some embodiments, tetraacetylethylene diamine can be included within the cleaning composition to react with the active oxygen and form a peracid or a peracid salt that acts as an antimicrobial agent. Other examples of active oxygen activators include transition metals and their compounds, compounds that contain a carboxylic, nitrile, or ester moiety, or other such compounds known in the art. In an embodiment, the activator includes tetraacetylethylene diamine; transition metal; compound that includes carboxylic, nitrile, amine, or ester moiety; or mixtures thereof. In some embodiments, an activator for an active oxygen compound combines with the active oxygen to form an antimicrobial agent.

In some embodiments, the cleaning composition is in the form of a solid block, and an activator material for the active oxygen is coupled to the solid block. The activator can be coupled to the solid block by any of a variety of methods for coupling one solid cleaning composition to another. For example, the activator can be in the form of a solid that is bound, affixed, glued or otherwise adhered to the solid block. Alternatively, the solid activator can be formed around and encasing the block. By way of further example, the solid activator can be coupled to the solid block by the container or package for the cleaning composition, such as by a plastic or shrink wrap or film.

Cleaning Builders or Fillers

The cleaning composition can optionally include a minor but effective amount of one or more of a filler which does not necessarily perform as a cleaning agent per se, but may cooperate with a cleaning agent to enhance the overall cleaning capacity of the composition. Examples of suitable fillers include, but are not limited to: sodium sulfate, sodium chloride, starch, sugars, and C1-C10 alkylene glycols such as propylene glycol.

pH Buffering Agents

Additionally, the cleaning composition can be formulated such that during use in aqueous operations, for example in aqueous cleaning operations, the wash water will have a desired pH. For example, compositions designed for use in providing a presoak composition may be formulated such that during use in aqueous cleaning operations the wash water will have a pH in the range of about 6.5 to about 14, and in some embodiments, in the range of about 7.5 to about 11. Liquid product formulations in some embodiments have a (10% dilution) pH in the range of about 7.5 to about 11.0, and in some embodiments, in the range of about 7.5 to about 9.0.

For example, a souring agent may be added to the cleaning composition such that the pH of the textile approximately matches the proper processing pH. The souring agent is a mild acid used to neutralize residual alkalines and reduce the pH of the textile such that when the garments come into contact with human skin, the textile does not irritate the skin. Examples of suitable souring agents include, but are not limited to: phosphoric acid, formic acid, acetic acid, hydrofluorosilicic acid, saturated fatty acids, dicarboxylic acids, tricarboxylic acids, and any combination thereof. Examples of saturated fatty acids include, but are not limited to: those having 10 or more carbon atoms such as palmitic acid, stearic acid, and arachidic acid (C20). Examples of dicarboxylic acids include, but are not limited to: oxalic acid, tartaric acid, glutaric acid, succinic acid, adipic acid, and sulfamic acid. Examples of tricarboxylic acids include, but are not limited to: citric acid and tricarballylic acids. Examples of suitable commercially available souring agents include, but are not limited to: TurboLizer, Injection Sour, TurboPlex, AdvaCare 120 Sour, AdvaCare 120 Sanitizing Sour, CarboBrite, and Econo Sour, all available from Ecolab Inc., St. Paul, Minn.

Fabric Relaxants

A fabric relaxant may be added to the cleaning composition to increase the smoothness appearance of the surface of the textile.

Fabric Softeners

A fabric softener may also be added to the cleaning composition to soften the feel of the surface of the textile. An example of a suitable commercially available fabric softener includes, but is not limited to, TurboFresh, available from Ecolab Inc., St. Paul, Minn.

Soil Releasing Agents

The cleaning composition can include soil releasing agents that can be provided for coating the fibers of textiles to reduce the tendency of soils to attach to the fibers. Examples of suitable commercially available soil releasing agents include, but are not limited to: polymers such as Repel-O-Tex SRP6 and Repel-O-Tex PF594, available from Rhodia, Cranbury, N.J.; TexaCare 100 and TexaCare 240, available from Clariant Corporation, Charlotte, N.C.; and Sokalan HP22, available from BASF Corporation, Florham Park, N.J.

Defoaming Agents

The cleaning composition can optionally include a minor but effective amount of a defoaming agent for reducing the stability of foam. Examples of suitable defoaming agents include, but are not limited to: silicone compounds such as silica dispersed in polydimethylsiloxane, fatty amides, hydrocarbon waxes, fatty acids, fatty esters, fatty alcohols, fatty acid soaps, ethoxylates, mineral oils, polyethylene glycol esters, and alkyl phosphate esters such as monostearyl phosphate. A discussion of defoaming agents may be found, for example, in U.S. Pat. Nos. 3,048,548 to Martin et al., 3,334,147 to Brunelle et al., and 3,442,242 to Rue et al., the disclosures of which are incorporated by reference herein.

Anti-Redeposition Agents

The cleaning composition can optionally include an anti-redeposition agent capable of facilitating sustained suspension of soils in a cleaning solution and preventing the removed soils from being redeposited onto the substrate being cleaned. Examples of suitable anti-redeposition agents include, but are not limited to: fatty acid amides, fluorocarbon surfactants, complex phosphate esters, polyacrylates, styrene maleic anhydride copolymers, and cellulosic derivatives such as hydroxyethyl cellulose, hydroxypropyl cellulose.

Stabilizing Agents

The cleaning composition may also include stabilizing agents. Examples of suitable stabilizing agents include, but are not limited to: borate, calcium/magnesium ions, propylene glycol, and mixtures thereof.

Dispersants

The cleaning composition may also include dispersants. Examples of suitable dispersants that can be used in the solid cleaning composition include, but are not limited to: maleic acid/olefin copolymers, polyacrylic acid, and mixtures thereof.

Optical Brighteners

The cleaning composition can optionally include an optical brightener, also referred to as a fluorescent whitening agent or a fluorescent brightening agent, and can provide optical compensation for the yellow cast in fabric substrates.

Fluorescent compounds belonging to the optical brightener family are typically aromatic or aromatic heterocyclic materials often containing a condensed ring system. A feature of these compounds is the presence of an uninterrupted chain of conjugated double bonds associated with an aromatic ring. The number of such conjugated double bonds is dependent on substituents as well as the planarity of the fluorescent part of the molecule. Most brightener compounds are derivatives of stilbene or 4,4'-diamino stilbene, biphenyl, five membered heterocycles (triazoles, oxazoles, imidazoles, etc.) or six membered heterocycles (naphthalamides, triazines, etc.). The choice of optical brighteners for use in compositions will depend upon a number of factors, such as the type of composition, the nature of other components present in the composition, the temperature of the wash water, the degree of agitation, and the ratio of the material washed to the tub size. The brightener selection is also dependent upon the type of material to be cleaned, e.g., cottons, synthetics, etc. Because most laundry cleaning products are used to clean a variety of fabrics, the cleaning compositions may contain a mixture of brighteners which are effective for a variety of fabrics. It is of course necessary that the individual components of such a brightener mixture be compatible.

Examples of suitable optical brighteners are commercially available and will be appreciated by those skilled in the art. At least some commercial optical brighteners can be classified into subgroups, including, but are not limited to: derivatives of stilbene, pyrazoline, carboxylic acid, methinecyanines, dibenzothiophene-5,5-dioxide, azoles, 5- and 6-membered-ring heterocycles, and other miscellaneous agents. Examples of particularly suitable optical brightening agents include, but are not limited to: distyryl biphenyl disulfonic acid sodium salt, and cyanuric chloride/diaminostilbene disulfonic acid sodium salt. Examples of suitable commercially available optical brightening agents include, but are not limited to: Tinopal 5 BM-GX, Tinopal CBS-CL, Tinopal CBS-X, and Tinopal AMS-GX, available from Ciba Specialty Chemicals Corporation, Greensboro, N.C. Examples of optical brighteners are also disclosed in "The Production and Application of Fluorescent Brightening Agents", M. Zahradnik, Published by John Wiley & Sons, New York (1982), the disclosure of which is incorporated herein by reference.

Suitable stilbene derivatives include, but are not limited to: derivatives of bis(triazinyl)amino-stilbene, bisacylamino derivatives of stilbene, triazole derivatives of stilbene, oxadiazole derivatives of stilbene, oxazole derivatives of stilbene, and styryl derivatives of stilbene.

Anti-Static Agents

The cleaning composition can include an anti-static agent such as those commonly used in the laundry drying industry to provide anti-static properties. Anti-static agents can generate a percent static reduction of at least about 50% when compared with a textile that is not subjected to treatment. The percent static reduction can be greater than 70% and it can be greater than 80%. An example of an anti-static agent includes, but is not limited to, an agent containing quaternary groups.

Anti-Wrinkling Agents

The cleaning composition can include anti-wrinkling agents to provide anti-wrinkling properties. Examples of anti-wrinkling suitable agents include, but are not limited to: siloxane or silicone containing compounds and quaternary ammonium compounds. Particularly suitable examples of anti-wrinkling agents include, but are not limited to: polydimethylsiloxane diquaternary ammonium, silicone copolyol fatty quaternary ammonium, and polydimethyl siloxane with polyoxyalkylenes. Examples of commercially available anti-wrinkling agents include, but are not limited to: Rewoquat SQ24, available from Degussa/Goldschmidt Chemical Corporation, Hopewell, Va.; Lube SCI-Q, available from Lambert Technologies; and Tinotex CMA, available from Ciba Specialty Chemicals Corporation, Greensboro, N.C.

Odor-Capturing Agents

The cleaning composition can include odor capturing agents. In general, odor capturing agents are believed to function by capturing or enclosing certain molecules that provide an odor. Examples of suitable odor capturing agents include, but are not limited to: cyclodextrins and zinc ricinoleate.

Fiber Protection Agents

The cleaning composition can include fiber protection agents that coat the fibers of the textile to reduce or prevent disintegration and/or degradation of the fibers. An example of a fiber protection agent includes, but is not limited to, cellulosic polymers.

Color Protection Agents

The cleaning composition can include color protection agents for coating the fibers of a textile to reduce the tendency of dyes to escape the textile into water. Examples of suitable color protection agents include, but are not limited to: quaternary ammonium compounds and surfactants. Examples of particularly suitable color protection agents include, but are not limited to: di-(nortallow carboxyethyl)hydroxyethyl methyl ammonium methylsulfate and cationic polymers. Examples of commercially available surfactant color protection agents include, but are not limited to: Varisoft WE 21 CP and Varisoft CCS-1, available from Degussa/Goldschmidt Chemical Corporation, Hopewell, Va.; Tinofix CL from Ciba Specialty Chemicals Corporation, Greensboro, N.C.; Color Care Additive DFC 9, Thiotan TR, Nylofixan P-Liquid, Polymer VRN, Cartaretin F-4, and Cartaretin F-23, available from Clariant Corporation, Charlotte, N.C.; EXP 3973 Polymer, available from Alcoa Inc., Pittsburgh, Pa.; and Coltide, available from Croda International Plc, Edison N.J.

Dyes/Odorants

Various dyes, odorants including perfumes, and other aesthetic enhancing agents may also be included in the cleaning composition. Examples of suitable commercially available dyes include, but are not limited to: Direct Blue 86, available from Mac Dye-Chem Industries, Ahmedabad, India; Fastusol Blue, available from Mobay Chemical Corporation, Pittsburgh, Pa.; Acid Orange 7, available from American Cyanamid Company, Wayne, N.J.; Basic Violet 10 and Sandolan Blue/Acid Blue 182, available from Sandoz, Princeton, N.J.; Acid Yellow 23, available from Chemos GmbH, Regenstauf, Germany; Acid Yellow 17, available from Sigma Chemical, St. Louis, Mo.; Sap Green and Metanil Yellow, available from Keyston Analine and Chemical, Chicago, Ill.; Acid Blue 9, available from Emerald Hilton Davis, LLC, Cincinnati, Ohio; Hisol Fast Red and Fluorescein, available from Capitol Color and Chemical Company, Newark, N.J.; and Acid Green 25, Ciba Specialty Chemicals Corporation, Greenboro, N.C.

Examples of suitable fragrances or perfumes include, but are not limited to: terpenoids such as citronellol, aldehydes such as amyl cinnamaldehyde, a jasmine such as C1S-jasmine or jasmal, and vanillin.

UV Protection Agents

The cleaning composition can include a UV protection agent to provide the fabric with enhanced UV protection. In the case of clothing, it is believed that by applying UV protection agents to the clothing, it is possible to reduce the harmful effects of ultraviolet radiation on skin provided underneath the clothing. As clothing becomes lighter in weight, UV light has a greater tendency to penetrate the clothing and the skin underneath the clothing may become sunburned. An example of a suitable commercially available UV protection agent includes, but is not limited to, Tinosorb FD, available from Ciba Specialty Chemicals Corporation, Greensboro, N.C.

Anti-Pilling Agents

The cleaning composition can include an anti-pilling agent that acts on portions of fibers that stick out or away from the fiber. Anti-pilling agents can be available as enzymes such as cellulase enzymes. Examples of commercially available anti-pilling agents include, but are not limited to: Puradex, available from Genencor International, Pal Alto, Calif.; and Endolase and Carezyme, available from Novozyme, Franklinton, N.C.

Water Repellency Agents

The cleaning composition can include water repellency agents that can be applied to textile to enhance water repellent properties. Examples of suitable water repellenancy agents include, but are not limited to: perfluoroacrylate copolymers, hydrocarbon waxes, and polysiloxanes.

Hardening Agents/Solubility Modifiers

The cleaning composition may include a minor but effective amount of a hardening agent. Examples of suitable hardening agents include, but are not limited to: an amide such stearic monoethanolamide or lauric diethanolamide, an alkylamide, a solid polyethylene glycol, a solid EO/PO block copolymer, starches that have been made water-soluble through an acid or alkaline treatment process, and various inorganics that impart solidifying properties to a heated composition upon cooling. Such compounds may also vary the solubility of the composition in an aqueous medium during use such that the cleaning agent and/or other active ingredients may be dispensed from the solid composition over an extended period of time.

Insect Repellants

The cleaning composition can include insect repellents such as mosquito repellents. An example of a commercially available insect repellent is DEET. In addition, the aqueous carrier solution can include mildewcides that kill mildew and allergicides that reduce the allergic potential present on certain textiles and/or provide germ proofing properties.

Other Ingredients

A wide variety of other ingredients useful in providing the particular cleaning composition being formulated to include desired properties or functionality may also be included. For example, the cleaning compositions may include other active ingredients, cleaning enzyme, carriers, processing aids, solvents for liquid formulations, or others, and the like.

The present invention relates to liquid and solid cleaning compositions including a ferric hydroxycarboxylate as the builder. When the cleaning composition is provided as a liquid, the present invention includes a gel or paste. When the cleaning composition is provided as a solid, the cleaning composition may take forms including, but not limited to: a cast, extruded, molded or formed solid pellet, block, tablet, powder, granule, flake and the like.

Exemplary ranges for components of the cleaning composition when provided as a concentrated warewashing detergent are shown in Table 1.

TABLE 1

Warewashing Composition

| Component | First Exemplary Range (wt %) | Second Exemplary Range (wt %) | Third Exemplary Range (wt %) |
|---|---|---|---|
| Water | 0-50 | 1-40 | 5-30 |
| Alkaline Source | 5-80 | 20-75 | 50-70 |
| Ferric Hydroxy-carboxylate | 1-60 | 5-50 | 10-40 |
| Bleach | 0-55 | 5-45 | 10-35 |
| Silicate | 0-35 | 5-25 | 10-15 |
| Dispersant | 0-10 | 0.001-5 | 0.01-1 |
| Enzyme | 0-15 | 1-10 | 2-5 |
| Corrosion Inhibitor | 0.01-15 | 0.05-10 | 1-5 |
| Surfactant | 0-2 | 0.5-1.5 | 0.5-1.5 |
| Fragrance | 0-10 | 0.01-5 | 0.1-2 |
| Dye | 0-1 | 0.001-0.5 | 0.01-0.25 |

The present cleaning compositions may include concentrate compositions or may be diluted to form use compositions. In general, a concentrate refers to a composition that is intended to be diluted with water to provide a use solution that contacts an object to provide the desired cleaning, rinsing, or the like. The cleaning composition that contacts the articles to be washed can be referred to as the use composition. The use solution can include additional functional ingredients at a level suitable for cleaning, rinsing, or the like.

A use solution may be prepared from the concentrate by diluting the concentrate with water at a dilution ratio that provides a use solution having desired detersive properties. The water that is used to dilute the concentrate to form the use composition can be referred to as water of dilution or a diluent, and can vary from one location to another. The typical dilution factor is between approximately 1 and approximately 500 but will depend on factors including water hardness, the amount of soil to be removed and the like. In an embodiment, the concentrate is diluted at a ratio of between about 1:10 and about 1:10,000 concentrate to water. Particularly, the concentrate is diluted at a ratio of between about 1:100 and about 1:1500 concentrate to water. More particularly, the concentrate is diluted at a ratio of between about 1:250 and about 1:500 concentrate to water. When the cleaning composition is diluted to a use solution, the ferric hydroxycarboxylate is effective at concentrations of between about 20 parts per million (ppm) and about 400 ppm and particularly between about 40 ppm and about 140 ppm. In particular, the ferric hydroxycarboxylate is effective at concentrations of less than approximately 100 ppm and less than approximately 40 ppm.

The use composition can have a solids content that is sufficient to provide the desired level of detersive properties while avoiding wasting the cleaning composition. The solids concentration refers to the concentration of the non-water components in the use composition. In an embodiment when the cleaning composition is provided as a use solution, the use composition can have a solids content of at least about 0.05 wt % to provide a desired level of cleaning. In addition, the use composition can have a solids content of less than about 1.0 wt % to avoid using too much of the composition. The use composition can have a solids content of about 0.05 wt % to about 0.75 wt %.

The concentrate may be diluted with water at the location of use to provide the use solution. The use solution is then applied onto the surface for an amount of time sufficient to remove soils from the surface. In an exemplary embodiment, the use solution remains on the surface for at least approximately 5 seconds to effectively remove the soils from the surface. The use solution is then rinsed from the surface.

The present ferric hydroxycarboxylate builder of the cleaning composition can be provided in any of a variety of embodiments of cleaning compositions. In an embodiment, the cleaning composition is substantially free of phosphorous-containing compounds, nitrilotriacetic acid (NTA) and ethylenediaminetetraacetic acid (EDTA). Substantially phosphorous-free refers to a composition to which phosphorous-containing compounds are not added. Should phosphorus-containing compounds be present through contamination, the level of phosphorus-containing compounds in the resulting composition is less than approximately 10 wt %, less than approximately 5 wt %, less than approximately 1 wt %, less than approximately 0.5 wt %, less than approximately 0.1 wt %, and often less than approximately 0.01 wt %. Substantially NTA or EDTA-free refers to a composition to which NTA or EDTA are not added. Should NTA or EDTA be present through contamination, the level of NTA or EDTA in the resulting composition is less than approximately 10 wt %, less than approximately 5 wt %, less than approximately 1 wt %, less than approximately 0.5 wt %, less than approximately 0.1 wt %, and often less than approximately 0.01 wt %. When the cleaning composition is NTA-free, the cleaning composition is also compatible with chlorine, which functions as an anti-redeposition and stain-removal agent. When diluted to a use solution, the cleaning composition includes phosphorous-containing components, NTA and EDTA concentrations of less than approximately 100 ppm, particularly less than approximately 10 ppm, and more particularly less than approximately 1 ppm.

The cleaning composition may be made using a mixing process. The cleaning composition, including the ferric hydroxycarboxylate, alkalinity source, surfactant or surfactant system and other functional ingredients are mixed for an amount of time sufficient to form a final, homogeneous composition. In an exemplary embodiment, the components of the cleaning composition are mixed for approximately 10 minutes.

A solid cleaning composition as used in the present disclosure encompasses a variety of forms including, for example, solids, pellets, blocks, tablets, and powders. By way of example, pellets can have diameters of between about 1 mm and about 10 mm, tablets can have diameters of between about 1 mm and about 10 mm or between about 1 cm and about 10 cm, and blocks can have diameters of at least about 10 cm. It should be understood that the term "solid" refers to the state of the cleaning composition under the expected conditions of storage and use of the solid cleaning composition. In general, it is expected that the cleaning composition will remain a solid when provided at a temperature of up to about 100° F. or lower than about 120° F.

In certain embodiments, the solid cleaning composition is provided in the form of a unit dose. A unit dose refers to a solid cleaning composition unit sized so that the entire unit is used during a single cycle, for example, a single washing cycle of a warewash machine. When the solid cleaning composition is provided as a unit dose, it can have a mass of about 1 g to about 50 g. In other embodiments, the composition can be a solid, a pellet, or a tablet having a size of about 50 g to 250 g, of about 100 g or greater, or about 40 g to about 11,000 g.

In other embodiments, the solid cleaning composition is provided in the form of a multiple-use solid, such as, a block or a plurality of pellets, and can be repeatedly used to generate aqueous cleaning compositions for multiple washing cycles. In certain embodiments, the solid cleaning composition is provided as a solid having a mass of about 5 g to about 10 kg. In certain embodiments, a multiple-use form of the solid cleaning composition has a mass of about 1 to about 10 kg. In further embodiments, a multiple-use form of the solid cleaning composition has a mass of about 5 kg to about 8 kg. In other embodiments, a multiple-use form of the solid cleaning composition has a mass of about 5 g to about 1 kg, or about 5 g and to about 500 g.

EXAMPLES

The present invention is more particularly described in the following examples that are intended as illustrations only, since numerous modifications and variations within the scope of the present invention will be apparent to those skilled in the art. Unless otherwise noted, all parts, percentages, and ratios reported in the following examples are on a weight basis, and all reagents used in the examples were obtained, or are available, from the chemical suppliers described below, or may be synthesized by conventional techniques.

Warewashing Test

To prepare plates for testing, a coffee dipper was filled with 17 grain hard water and heated to between about 185° F. and about 195° F. 150 Lipton tea bags were added and agitated for between about 5 minute and about 7 minutes. The tea bags were removed while squeezing the liquid out of them into the broth. The temperature in the dipper was then decreased to about 160° F. and about four 12 ounce cans of Carnation Evaporated Milk was added and stirred for about 30 minutes A set of 15 plates was added to the dipper and dipped 25 times at 1 minute in solution and 1 minute out of solution for each dip. If necessary, deionized water was added to the dipper to replace any water loss by evaporation.

To determine the ability of compositions of the present invention to remove soil, various warewashing tests were performed. Before the plates were washed, the amount of soil on the plates were noted. A sump was filled with 17 grain water and cleaning was added. The warewash machine was allowed to run for one cycle. After making sure that the temperature is at between about 150° F. and 155° F., a set of 3 plates were placed on a rack and positioned in the warewash machine. The plates were washed and rinsed for one cycle. The plates were them removed and allowed to dry. The amount of soil remaining on the plates was noted.

Generally, two cleaning compositions were considered to perform substantially similarly, and thus function as effective replacements for one another, when the performance of the two compositions did not vary by more than about 10%. Each of the compositions tested used Solid Power, a detergent available from Ecolab Inc., St. Paul, Minn. as a base.

Example 1 and Comparative Example A

The composition of Example 1 included a cleaning composition of the present invention using Solid Power brand detergent, a detergent available from Ecolab Inc., St. Paul, Minn., as the base and ferric gluconate as a builder. In particular, the composition of Example 1 replaced the Dissolvine GL-38, a known builder on a 1:1 active weight basis. The results are shown in FIG. 1 which is a graph showing percent stain removal. The results demonstrate that ferric gluconate works as well as Dissolvine GL-38.

Figure 2:
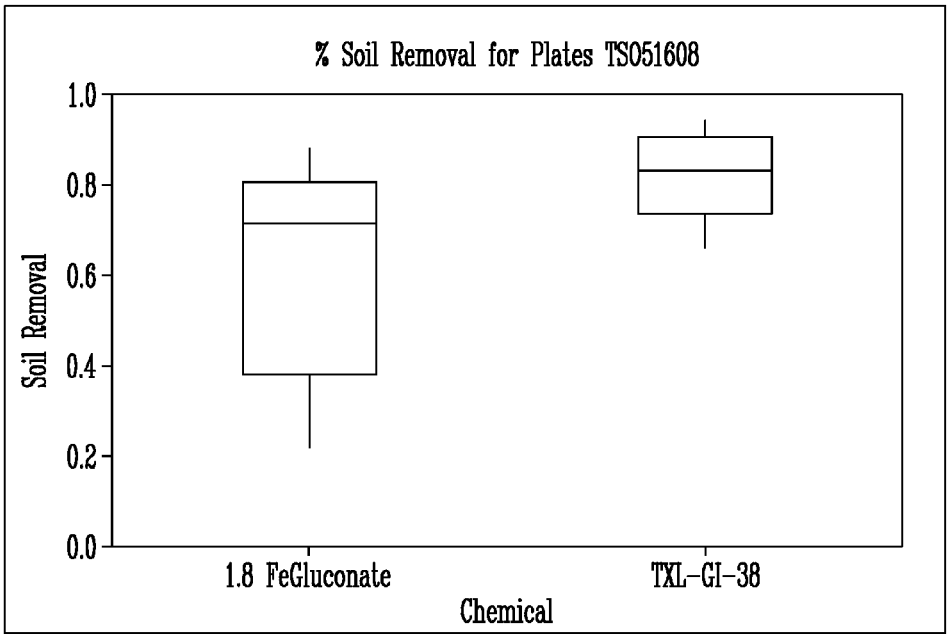
FIG. 2 shows the percent tea soil removal of modified Solid Power detergent where GL-38 was replaced with ferric gluconate on a 1.8:1 active weight basis. As can be seen, ferric gluconate is similar to GL-38 on removing the tea soil.
Figure 3:
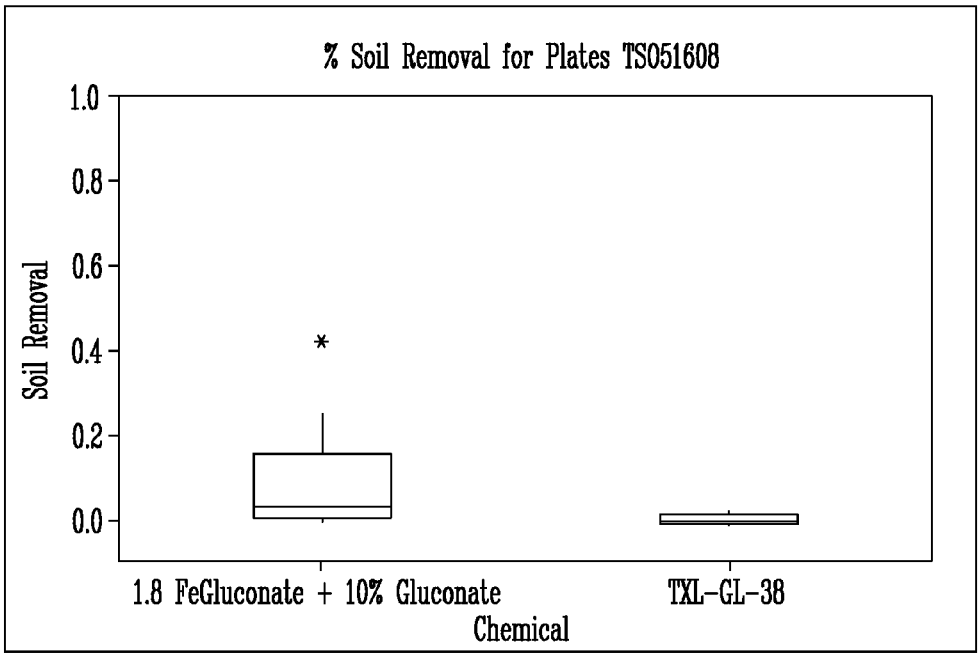

FIG. 2 shows the percent stain removal at 1.8 ferric gluconate and FIG. 3 shows the percent stain removal at 1.8 ferric gluconate with 10% gluconate.

Hampshire Titration Test

To determine the capacity of a chelating agent to bind calcium, the chelating agent is titrated with a $CaCl_2$ solution in the presence of carbonate ions. The titration test measures the amount of calcium that can be added to a solution containing carbonate, an alkalinity source and the chelating agent before calcium carbonate begins to precipitate. The Hampshire titration test has been associated with the chelation capacity of the test sample.

A solution containing about 1 gram (g) of chelating agent, about 10 milliliters (ml) of 2% $Na_2CO_3$ and deionized water in an amount sufficient to give a total sample weight of 100 grams was heated to about 140° F. while stirring. When the temperature was stable at about 140° F., the pH was adjusted accordingly by the addition of 50% NaOH or 15.75% HCl. The solution was titrated with 0.25 M $CaCl_2$ until a distinct and permanent turbidity appeared. The stage prior to turbidity is recognized by a slight opalescence.

Example 2 and Comparative Example B

To determine the ability of a ferric hydroxycarboxylate (ferric gluconate) to bind calcium, the Hampshire titration test was performed. In particular, the composition of Example B included 1.678 mMols ferric glucoheptonate.

Table 2 provides the pH of the solution, end point, calcium mMols and Mol ferric gluconate/Mol $Ca^{+2}$ and Mol $Ca^{+2}$/Mol ferric gluconate for the composition of Example 2 and the pH of the solution, end point, calcium mMols and Mol gluconate/Mol $Ca^{+2}$ and Mol $Ca^{+2}$/Mol gluconate for the composition of Comparative Example B.

of ferric gluconate. In contrast, as the pH increases from 9 to 14, the chelating capacity of gluconate decreases.

Food and Beverage Beaker Test

A reagent was first prepared by creating a hardness solution and a sodium bicarbonate solution. To create the hardness solution, about 33.45 grams of $CaCl_2.2H_2O$+23.24 g $MgCl_2.6H_2O$ was dissolved in a 1 liter volumetric flask and diluted to volume with deionized water. To create the sodium bicarbonate solution, about 56.25 grams of $NaHCO_3.2H_2O$ was dissolved in a 1 liter volumetric flask and diluted to volume with deionized water.

About 1000 milliliters (ml) of deionized water and a 1.5 inch stir bar was added to each of four 1000 or 1500 ml beakers. The beakers were placed on a hot plate and heated while about 5 mls of sodium bicarbonate solution was added. Once the water temperature reached about 85° F., the hardness solution was added to each beaker, with each 1 ml equaling about 2 grains, and run in 2 grain increments unless otherwise specified. About 4 mls of ferric hydroxycarboxylate was added to each beaker, which is equal to about 0.40% or 1 ounce per 2 gallons. After the sample is completely mixed, the stirrers are turned off.

When the temperature reached about 85° F., enough alkalinity (NaOH) was added to the beakers to reach a preset alkalinity concentration, then an initial transmittance reading was taken. Transmittance readings were also taken at 140° F. and 160° F. at 560 nm. 100% transmittance indicates that the solution is crystal clear and there is no formation of any precipitate. 99% or 98% transmittance is within the instrument and method error and are also considered as full clarity. Although at 90% transmittance the solution will look clear to the naked eye, some initial nucleation may be starting to form. Thus, if the percent transmittance is between about 98% and about 100%, the solution is considered to be free of precipitate. Lower percentages of transmittance indicate some initial micro nucleation.

Example 3 and Comparative Example C

To determine the ability of a ferric hydroxycarboxylate (ferric gluconate) to bind calcium, the beaker test was performed with 300 ppm $Na_2CO_3$ and 330 ppm NaOH and 17 grain water hardness.

In particular, the composition of Example 3 included ferric glucoheptonate.

The composition of Comparative Example C was tested at the same conditions as the composition of Example 2 except that the composition of Comparative Example C included only sodium glucoheptonate.

TABLE 2

| pH | 9 | 9.5 | 10 | 10.5 | 11 | 11.5 | 12 | 12.5 | 13 | 13.5 | 14 |
|---|---|---|---|---|---|---|---|---|---|---|---|
| Example 2 - Chelation of Ca by Ferric Gluconate | | | | | | | | | | | |
| End pt. (ml) | 4.37 | 4.73 | 4.85 | 5.37 | 5.75 | 7.68 | 8 | 7.53 | NA | NA | NA |
| Ca mMols | 1.09 | 1.18 | 1.21 | 1.34 | 1.44 | 1.92 | 2 | 1.88 | NA | NA | NA |
| Mol ferric gluconate/Mol $Ca^{+2}$ | 1.54 | 1.42 | 1.38 | 1.25 | 1.17 | 0.88 | 0.84 | 0.89 | NA | NA | NA |
| Mol $Ca^{+2}$/Mol ferric gluconate | 0.65 | 0.71 | 0.72 | 0.8 | 0.86 | 1.14 | 1.19 | 1.12 | NA | NA | NA |
| Comparative Example B - Chelation of Ca by Gluconate | | | | | | | | | | | |
| End pt. (ml) | 1.13 | 0.4 | 0.55 | 0.517 | 0.617 | 0.65 | 0.55 | 0.866 | 0.283 | 0.2 | 0.15 |
| Ca mMols | 0.283 | 0.100 | 0.138 | 0.129 | 0.154 | 0.163 | 0.138 | 0.217 | 0.071 | 0.050 | 0.038 |
| Mol gluconate/Mol $Ca^{+2}$ | 7.40 | 20.90 | 15.20 | 16.17 | 13.55 | 12.86 | 15.20 | 9.65 | 29.54 | 41.80 | 55.73 |
| Mol $Ca^{+2}$/Mol gluconate | 0.14 | 0.05 | 0.07 | 0.06 | 0.07 | 0.08 | 0.07 | 0.1 | 0.03 | 0.02 | 0.02 |

The data in Table 2 shows that as the pH increases from 9 to 12.5, ferric gluconate ions chelate more calcium per mole At a 1:1 mole ration of ferric glucoheptonate to hardness was clear all through the increase in temperature, but they turned cloudy while cooling down. A ration of 1.6:1 of ferric glucoheptonate to hardness remained clear even while cooling to room temperature.

Example 4 and Comparative Example D

The composition of Example 4 included ferric mucate and was tested with 743 ppm (equivalent to the number of moles of $CaCO_3$ on 16 grains hardness), 300 ppm $Na_2CO_3$ and 330 ppm NaOH and 20-30 grain water hardness.

At a ration of 0.8:1 moles of ferric mucate:hard water, the system remained clear through heating and cooling back to room temperature.

Example 5 and Comparative Example E

Next the composition of Example 4 which included ferric muctate was tested at 664 ppm (equivalent to the number of moles of $CaCO_3$ on 16 grains hardness), 300 ppm $Na_2CO_3$ and 330 ppm NaOH.

Not even using 4 times the amount needed to control the mole ratio would prevent $CaCO_3$ precipitation.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

What is claimed is:

1. A cleaning composition for removing soils comprising:

(a) an iron salt;

(b) a hydroxycarboxylate; and (c) an alkalinity source present in the composition between about 20 wt % and about 75 wt %;

(d) wherein the pH of the cleaning composition is between about 10.5 and about 12;

(e) wherein the iron salt and the hydroxycarboxylate combine to form a ferric hydroxycarboxylate, which is present in the cleaning composition between about 1 wt % and about 60 wt %; and (f) wherein the cleaning composition contains less than about 0.01 wt % non-biodegradable aminocarboxylates.

2. The cleaning composition of claim 1, wherein the ferric hydroxycarboxylate comprises one or more of ferric gluconate, ferric glucoheptonate, ferric mucase, ferric tartrate, ferric glucarate, ferric saccharate and ferric malate.

3. The cleaning composition of claim 1, wherein the ferric hydroxycarboxylate comprises ferric gluconate.

4. The cleaning composition of claim 3, wherein the ferric gluconate has a molar ratio of between about 0.5:1.5 and about 1.5:0.5 gluconic acid to sodium gluconate.

5. The cleaning composition of claim 1, further comprising a surfactant.

6. The cleaning composition of claim 1, wherein the ferric hydroxycarboxylate has a weight ratio of between about 40:60 and about 75:25 alkali metal salt of a hydroxycarboxylate or free hydroxy-carboxylic acid to ferric salt.

7. A detergent composition consisting essentially of:

(a) an alkalinity source selected from the group consisting of an alkali metal hydroxide, an alkali metal carbonate, an alkali metal silicate, or combinations thereof, wherein said alkalinity source constitutes between about 50% and about 70% by weight of the detergent composition; and (b) a ferric hydroxycarboxylate constituting between about 10% and about 50% by weight of the cleaning composition, wherein the ferric hydroxycarboxylate comprises one of ferric gluconate, ferric glucoheptonate, ferric, mucate, ferric tartrate, ferric glucarate, ferric saccharate and ferric malate; wherein the ferric hydroxycarboxylate has a molar ratio of between about 0.5:1.5 and about 1.5:0.5 alkali metal salt of a hydroxycarboxylate or free hydroxycarboxylic acid to ferric salt;

(c) a surfactant system constituting between about 0.01% and about 50% by weight of the detergent composition;

and wherein the detergent composition contains less than about 0.01 wt % non-biodegradable aminocarboxylates.

8. The detergent composition of claim 7, wherein the ferric hydroxycarboxylate has a weight ratio of between about 40:60 and about 95:1 alkali metal salt of a hydroxycarboxylate or free hydroxycarboxylic acid to ferric salt dissolved with an alkali metal hydroxide.

9. The detergent composition of claim 7, wherein the cleaning composition comprises less than about 10% phosphorous-containing compounds by weight.

10. The detergent composition of claim 7, wherein the cleaning composition comprises less than about 10% sulfonated or sulfated surfactant by weight.

* * * * *